US009192006B2

(12) United States Patent
Hoogzaad et al.

(10) Patent No.: US 9,192,006 B2
(45) **Date of Patent: *Nov. 17, 2015**

(54) ELECTRONIC DEVICE FOR DRIVING LIGHT EMITTING DIODES

(71) Applicant: NXP B.V., Eindhoven (NL)

(72) Inventors: Gian Hoogzaad, Mook (NL); Frans Pansier, Nuenen (NL)

(73) Assignee: NXP B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/317,486

(22) Filed: Jun. 27, 2014

(65) Prior Publication Data

US 2015/0015155 A1 Jan. 15, 2015

Related U.S. Application Data

(63) Continuation of application No. 13/546,110, filed on Jul. 11, 2012, now Pat. No. 8,786,208, which is a continuation of application No. 12/517,247, filed as application No. PCT/IB2007/054843 on Nov. 29, 2007, now Pat. No. 8,237,372.

(30) Foreign Application Priority Data

Dec. 4, 2006 (EP) ..... 06125362

(51) Int. Cl.

| | |
|---|---|
| ***H05B 41/36*** | (2006.01) |
| ***H05B 33/08*** | (2006.01) |
| ***H05B 37/02*** | (2006.01) |

(52) U.S. Cl.

CPC ..... *H05B 33/0815* (2013.01); *H05B 33/0818* (2013.01); *H05B 33/0824* (2013.01); *H05B 33/0851* (2013.01); *H05B 37/02* (2013.01)

(58) Field of Classification Search

CPC ..... H05B 33/0815; H05B 33/0827; H05B 37/02; H05B 33/0851; H05B 33/0866; H05B 33/0884; H05B 33/089; H02M 2001/0032; H02M 3/156; Y02B 20/346; F21K 9/00; Y10S 362/80

USPC ..... 315/130, 129, 136, 291, 294, 287, 299, 315/320, 246, 312, 324, 362

See application file for complete search history.

(56) References Cited

U.S. PATENT DOCUMENTS

| | | | | |
|---|---|---|---|---|
| 5,657,215 | A | 8/1997 | Faulk | |
| 6,215,290 | B1 * | 4/2001 | Yang et al. | 323/282 |
| 7,054,170 | B2 * | 5/2006 | Yang et al. | 363/21.18 |
| 7,123,494 | B2 * | 10/2006 | Turchi | 363/89 |
| 7,233,115 | B2 | 6/2007 | Lys | |
| 7,276,863 | B2 | 10/2007 | Lee | |
| 7,358,685 | B2 | 4/2008 | Lee | |
| 7,423,389 | B2 | 9/2008 | Lee | |

(Continued)

FOREIGN PATENT DOCUMENTS

EP 1 033 903 A 9/2000

*Primary Examiner* — Vibol Tan

(57) ABSTRACT

The present invention relates to an electronic device for driving a light emitting diode, which includes a switch (Ts) being adapted to switch a switch-mode power converter, and controlling means (CNTL) being adapted for controlling the switch (Ts) in response to a sensing value (Vs) indicative of a current of the switch-mode power converter and for controlling by the switch (Ts) the output voltage of the switched power converter and a current (Iout) through the light emitting diode.

16 Claims, 9 Drawing Sheets

(56) References Cited

U.S. PATENT DOCUMENTS

| | | | | |
|---|---|---|---|---|
| 7,541,791 | B2 | 6/2009 | Quazi | |
| 7,741,787 | B2 | 6/2010 | Chen | |
| 7,825,612 | B2 | 11/2010 | Lee | |
| 2005/0218838 | A1 | 10/2005 | Lys | |
| 2006/0261752 | A1 | 11/2006 | Lee | |
| 2006/0261754 | A1 * | 11/2006 | Lee | 315/291 |

* cited by examiner (a)

(b)

ELECTRONIC DEVICE FOR DRIVING LIGHT EMITTING DIODES

RELATED PATENT DOCUMENTS

This patent document is a continuation under 35 U.S.C. §120 of U.S. patent application Ser. No. 13/546,110 filed on Jul. 11, 2012, which is a continuation under 35 U.S.C. §120 of U.S. patent application Ser. No. 12/517,247 filed on Jun. 2, 2009, which is a 35 U.S.C. §371 national stage entry of International Application No. PCT/IB2007/054843 filed on Nov. 29, 2007, which claims priority benefit under 35 U.S.C. §119 of European Patent Application No. 06125362.1 filed on Dec. 4, 2006, to which priority is also claimed here.

FIELD OF THE INVENTION

The present invention relates to an electronic device for driving light emitting diodes, more specifically to a driver configuration for light emitting diodes using switch-mode power converters. The invention further relates to a system comprising the electronic device and the light emitting diodes, and a method of driving the diodes.

BACKGROUND OF THE INVENTION

Light emitting diodes (LEDs) are broadly used for light sources, displays, and signaling elements. As LEDs are more power efficient than conventional light sources, and since the packing density allows high quality displaying functionality, a significant increase in applications using LEDs can be observed. LEDs are typically used in string-like or array-like configurations, where a large number of light emitting diodes is coupled to form either stings or display panels, or to provide efficient light or backlight sources for numerous applications. Accordingly, there is a general motivation to provide power efficient, small, and cheap electronic devices for driving the LEDs. The conventional approach to drive LEDs consists in coupling a current source to the LEDs in order to provide a constant current through the LEDs, such that a specific intensity and color of the light emission is achieved. A more sophisticated conventional approach includes a switch, as for example a metal oxide silicon field effect transistor (MOSFET), which is coupled in series with the LEDs. The LED is switched on and off by the switch at a high frequency. The ratio of the ON- and OFF-periods allows to control the light emission of the LEDs. In addition to this well-known control mechanism, a variety of power management concepts is applied for the current sources or voltage sources. In order to provide a variety of different regulated output voltages and output currents from a single power source, the switched power regulators are used, such as boost-, buck-, and buck-boost-converters. Generally, LEDs are to be driven at a constant current. Switch-mode solutions are preferred, as they provide an improved efficiency for varying load conditions caused by production spread, temperature variations, and ageing of the LED forward voltage. Additionally, taking the whole system into consideration, low cost and good color stability are advantages of the switch mode solutions. The switch mode solutions are most appropriate for 0D and 1D dimming backlight systems for mass production. The basic principle of the switch mode power converters consists in supplying a specific current to an inductor (e.g. a coil), decoupling the voltage source from the inductor by a switch, and driving for a limited time a load by the energy stored in the decoupled inductor. Once a specific part of the energy in the inductor is spent, the inductor is again coupled to the voltage source. Particular arrangements of switches, inductors, diodes and capacitors in combination with specific switching mechanisms and sequences allow to provide output voltages in a wide range being above, below or above and below the input voltage.

Although switch mode power converters are beneficial in terms of power consumption and flexibility, a major drawback of the conventional solutions resides in the rather complex control mechanisms to establish well-defined conditions for the LEDs. Providing an appropriate current through the LEDs for a specific light emission and other parameters and preserving at the same time the suitable timing (e.g. for PWM) for the switched voltage or current sources impose high requirements on the control circuitry. If, for example, the control mechanism for the LEDs is too slow, variations of the input and output voltage, as well as variations of internal parameters will become visible in variations of luminance and color stability of the LEDs.

SUMMARY OF THE INVENTION

It is an object of the present invention to provide a control mechanism for driving and dimming light emitting diodes being less complex and more efficient than the prior art.

According to an aspect of the present invention an electronic device for driving a light emitting diode is provided, which includes a switch being adapted to switch a switch-mode power converter being coupled to the light emitting diode, and controlling means for controlling the switching of the switch in response to a sensing value, which is indicative a current through the switch, wherein the controlling means are further adapted for controlling by the switching of the switch the output voltage of the switch-mode power converter and at the same time a current of the light emitting diode. According to this aspect of the invention, an electronic device is provided having reduced complexity as only one switch is used for two control mechanisms. The first control mechanism is in the form of dimming of a light emitting diode or a string of light emitting diodes. The second control mechanism is the control of the switch-mode power converter. This aspect of the present invention combines in an advantageous manner both control mechanisms in one. The controlling means have to be adjusted in accordance with the particular requirements of the combined control. This aspect of the invention may be understood as if the control switch of the switch-mode power converter is adapted to determine also the current through the light emitting diode. The switch may be a single switch, as a single transistor, but the switch may also be implemented by a plurality of switches as long as those switches operate as the single switch mentioned above. The switch may preferably be adapted to provide a current path, which is not the current path directly through the light emitting diode. A current path is provided for a current not flowing through the LED or a string of LEDs. Accordingly, the switch may be arranged in parallel to the light emitting diode or a string of light emitting diodes or in another manner, such that a current output by the power converter is passed through the switch (if turned on) and not through the LEDs. According to this aspect of the invention, if the switch is turned on, a current is provided which somehow bypasses the light emitting diode or the string of diodes. According to still another aspect of the present invention, the sensing value is indicative of the current through the switch. This aspect of the present invention relates to a specific arrangement, where the switch bypasses the light emitting diodes. The current through the switch may be sensed by measuring the voltage across a resistor other resistive device. The so established sensing value is proportional to the current through the switch and may preferably be used the above-mentioned sensing value for controlling the switching of the switch.

According to an aspect of the present invention the electronic device comprises further comparing means for comparing the sensing value to a compensated reference voltage and compensation means for providing and determining the compensated reference voltage, such that the current through the light emitting diode is regulated and becomes substantially independent from the input and output voltage of the switch mode power converter. In other words, the present invention provides a control mechanism is not only less complex than the prior art, since only a single switch is used for two basic control mechanisms. Additionally, according to this aspect of the present invention, a concept is provided for the single switch mechanism to adjust the current through the light emitting diode independently from the input voltage of the switch-mode driver and supply voltage by which the diodes are supplied, although there is only a single switch. The present invention provides that the reference voltage, which is used to determine the appropriate timing for switching the switch on and off, is adapted or compensated, such that the influence of the input and output voltage of the switch-mode power supply on the current through the diode is compensated. Basically, the reference value which is compared to a sensing value for determining whether the switch is to be turned on or off, is calculated in consideration (i.e. on the basis) of the output and/or input voltage levels of the switch-mode power supply. This compensation means controls the current cycle-by-cycle which gives the current source for the LEDs an ultimate wide bandwidth. This large bandwidth current source character enables the combination of PWM dim and switch-mode driver control in one switch (as mentioned above). The relations and dependencies between the output and input voltages of the switch-mode power supply and the current through the light emitting diodes dependent on the specific arrangement and they may be manifold. However, according to a basic idea of this aspect of the present invention, the relationship between the output and input voltage levels of the switch-mode power supply and the current through a light emitting diode can be established. This may be carried out based on the basic rule that the input power and the output power of the switch-mode power supply are to be equal. Further, this equation is solved for the output current, which is the current through the light emitting diode, in relation to the peak input current. Replacing the peak input current by the peak voltage provides a relation between a peak input voltage and the output current. This equation can be exploited to determine how the output current through the light emitting diodes depends on output and the input voltage levels of the switch-mode power supply. If the influence of input and output voltage on the output current is compensated, for example by measuring these voltages and calculating respective compensation values to eliminate the influence, the so established systems provides an output current, which is basically independent from the output and input voltages of the switch-mode power supply. This is particularly surprising as the control mechanisms for the output current and the switch-mode power supply rely both on the same single switch.

According to the different aspects of the invention relating to compensation techniques in view of the above explanations, the compensated reference voltage may be determined based on a combination of the input voltage and an output voltage, based on the square root of the output voltage, based on sums, differences, products and quotients of input and output voltages and combinations thereof.

According to an aspect of the present invention, the controlling means are further adapted to control the switch-mode power converter and the current through the light emitting diode (or diodes e.g. string of diodes) in an arrangement wherein a fly-back diode and an inductor of the switch-mode power converter are arranged to form a loop with the light emitting diode and wherein the switch is coupled to provide the parallel current path from between the inductor and the fly-back diode to ground. This is a specific configuration, wherein the switch and switch-mode power supply are arranged such that if the switch is turned off, a current circulates through fly-back diode and the light emitting diodes (or a string thereof) in forward direction. The controlling means have to be adapted to take account of this configuration. The electronic device may also comprise some of the other components, like the fly-back diode or the inductor (for example as an integrated device). However, the basic idea resides in the appropriate configuration of the controlling means.

According to another aspect of the present invention, the controlling means are further adapted to receive timing information, as for example a clock provided by an oscillator for switching the switch in accordance with the timing information. This aspect of the present invention provides an additional degree of freedom for the present invention, as switching the switch on and off may additionally be determined by the clock instead of only by voltage levels. Accordingly, the switch may for example be turned off for an arbitrary amount of time.

According to still another aspect of the present invention, the control mechanism is adapted for controlling the switch in accordance with an upper and a lower compensated reference voltage in a hysteretic manner. Accordingly, the above-explained principles of the present invention may also be applied to configurations, where the current through the light emitting diode (or string of diodes) should contain a DC-portion and an alternating portion. The switch is controlled in response to sensing value which is indicative of for example the current through the switch. If the sensing value reaches an upper level, the switch may be turned off, whereas, if a lower level is reached the switch is turned on. Further, this mechanism may be implemented in a hysteretic manner. Accordingly, a comparing means, such as comparator, compares the sensing value with a single reference value. Each time the sensing value equals or exceeds the reference value, the reference value is replaced by the respective other limit. Further, according to an aspect of the present invention, the reference values may be implemented as compensated reference values in order to make the reference values independent from input and output voltages or the like from the switch-mode voltage supply. The concept set out above may be applied to the upper reference value and the lower reference value.

In the above-mentioned configurations, the switch may be implemented as a single transistor or as multiple transistors operating in accordance with the above-described principles. Further, in the above-explained aspects of the present invention, a light emitting diode may always be replaced by a string of light emitting diodes, although some embodiments may be explained with respect to only one light emitting diode. All devices, means and circuits may preferably be provided by a single or multiple integrated circuitries on a single die of a semiconductor substrate or a plurality thereof.

Further, according to the invention, a integrated device may be provided, where input or output pins are configured to be directly or indirectly coupled to light emitting diode and/or a string of light emitting diodes, wherein these pins are configured to drive the light emitting diode and/or the string of light emitting diodes in accordance with the controlling mechanism according to any one of the above aspects of the invention. In particular, the above aspects may be combined in any number or composition without departing from the invention.

BRIEF DESCRIPTION OF THE DRAWINGS

These and other aspects of the invention will be apparent from and elucidated with reference to the embodiments described hereinafter. In the following drawings.

DETAILED DESCRIPTION OF EMBODIMENTS

Figure 1:
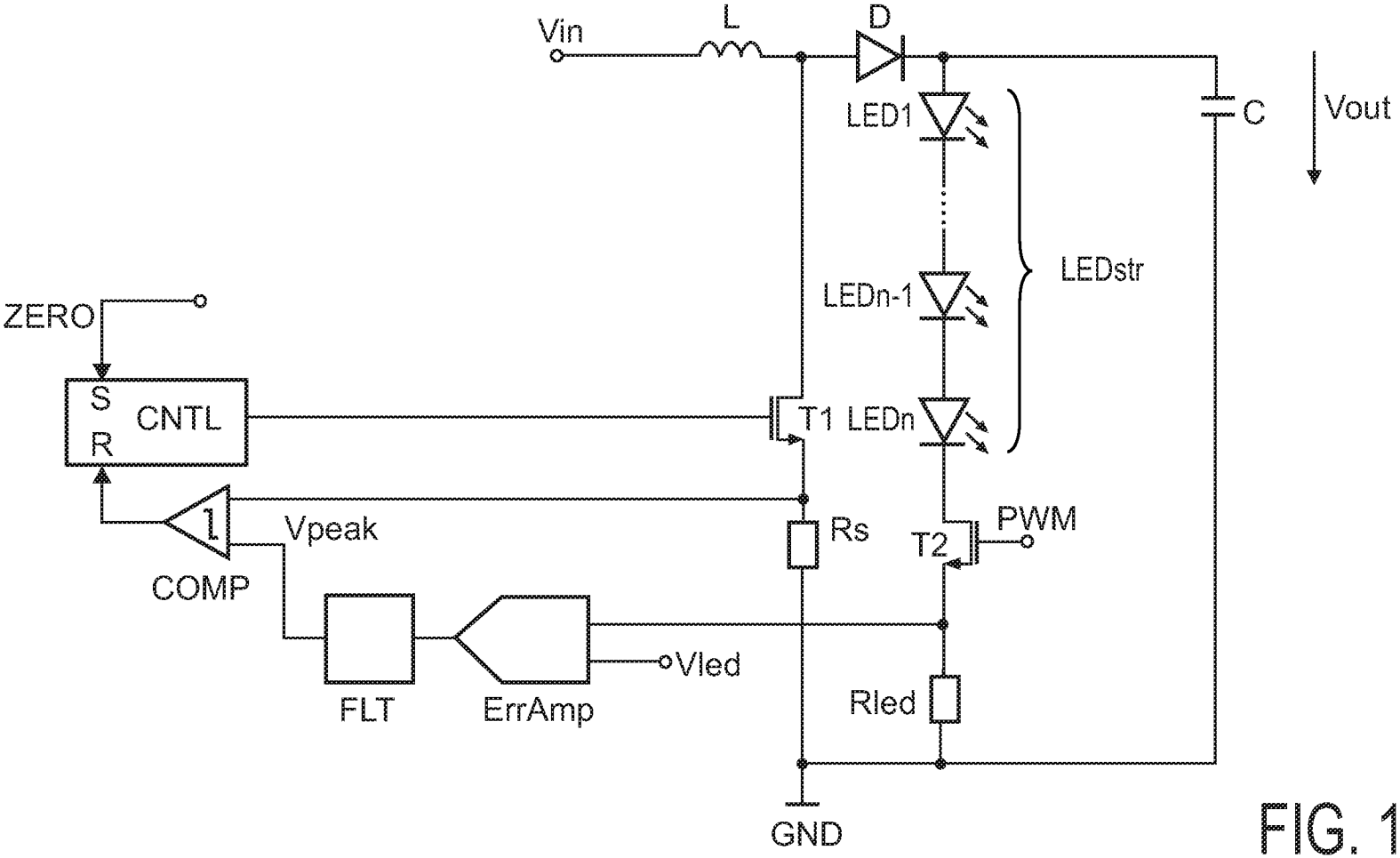
FIG. 1 shows a simplified schematic of a driver configuration for a string of LEDs according to the prior art, FIGS. 2 (*a*) and (*b*) show a simplified schematic and corresponding waveforms of a first embodiment of the invention.

FIG. 1 shows a simplified schematic of a conventional switch mode current source. A string LEDstr of light emitting diodes LED1, . . . , LEDn−1, LEDn is coupled to a boost converter including inductor L, capacitor C, switch transistor T1, and sensing resistor Rs. The luminance of the LED string LEDstr is controlled by a second switch transistor T2 in series to the string LEDstr being switched on and off by a pulse width signal PWM. The current through the LED string LEDstr is sensed by the error amplifier at a sensing resistor Rled. The voltage level at Rled is compared to a reference voltage level Vled in an error amplifier ERRORAMP. The deviation is amplified and passed to a filter, which extracts the appropriate reference value for the peak detector COMP. The peak reference value is compared to the voltage level at the sensing resistor Rs of the buck converter. The comparator COMP provides a peak level to the control unit CNTL, determines the turn-off moment of transistor T1. A second input ZERO to the control mechanism determines the turn-on moment of transistor T1. Although this describes a boost converter in self-oscillating or boundary conduction mode, operation modes like continuous conduction and discontinuous conduction mode are used as well. The control loop includes an error amplifier Err Amp for comparing the sensed value at Rled to a reference voltage level Vled, a filter FLT for averaging several conversion cycles and for stabilizing the loop and a comparator. The comparator compares the result of the filtering Vp to the sensed voltage level Vs and provides a comparison result to the control unit CNTL. Usually, the control loop shows several poles and zeros in the transfer function, such that the typical bandwidth is about a few kHz for a 100 kHz switching frequency. The limited bandwidth is also the major drawback of this configuration, which is usually not sufficient to accurately implement the dimming system requirement for color stability of e.g. approximately 500 Hz PWM. The actual color point of the light emitted by the LED string LEDstr depends on the current through the LED. The color point may shift especially for low currents. Accordingly, the perceived color depends on the ratio of the time that the full current is applied with respect to the time that a low current flows through the LED. A low current through the LED string LEDstr occurs typically at start up and shut down of the device. Therefore, the "current tail" should be as small as possible, which requires a small output capacitance. In steady state situations, the negative impact of a capacitance can be compensated. However, dimming may still result in discoloration, if the light output is dimmed, at least if PWM dimming is assumed. This effect is due to the influence of the current tail on the discoloration. Tests on a high and true color monitor showed that for very color sensitive applications, the conventional solutions do not meet the requirements. Although sometimes no discoloration may be observed, precise measurements reveal that these systems do not comply with the requirements. A consequence of this deficiency is that additional switches have to be included parallel to or in series with the LED string LEDstr to establish precise PWM dimming. This results in additional costs and additional complexity of the conventional circuits. Accordingly, an extra PWM dim switch is required.

As a general remark, the prior art provides two control loops. An first loop, which is dedicated to control the peak and zero current shapes in the inductor L and an second loop that regulates the reference value for the peak detector to a value desired for the LED current. According to an aspect of the present invention, the two-loop control mechanism will be improved by the inventive concept, which makes it possible to waive one loop and to provide both control functions by a single, for example, only the inner loop.

Figure 2:
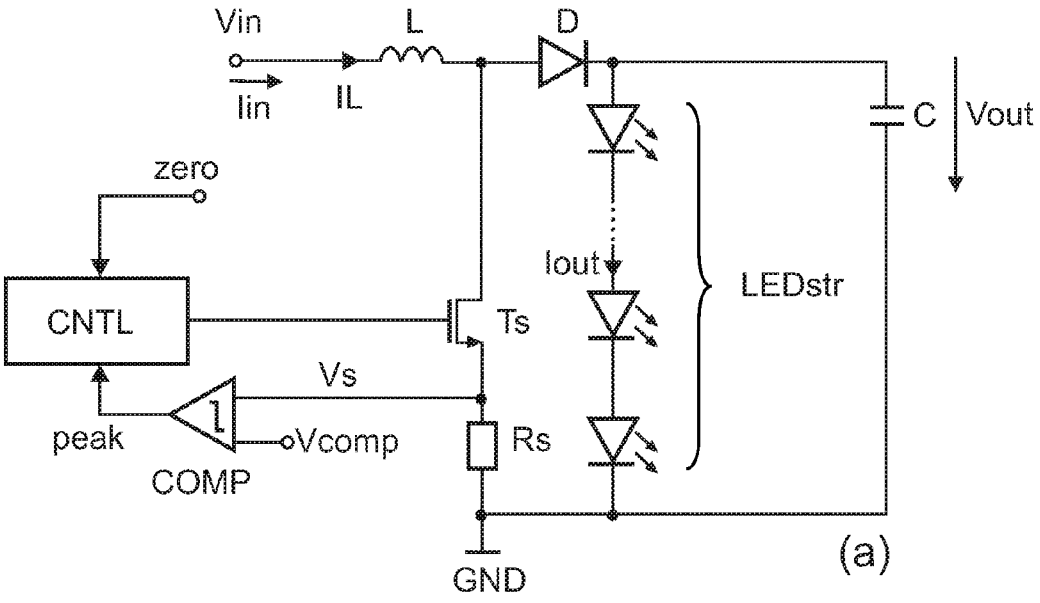
Figure 2:
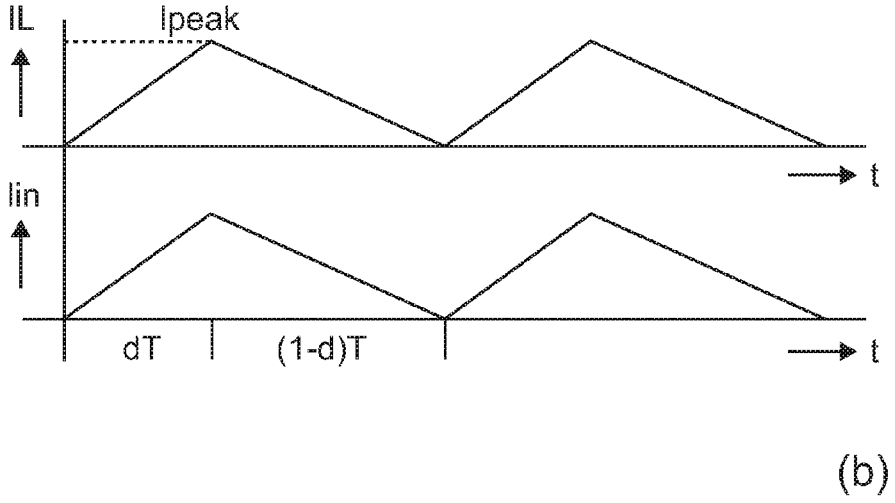

FIG. 2 (*a*) shows a simplified schematic of a first embodiment of the present invention. If, for example, a 24 V bus voltage is used in LCD backlight systems, boost or buck-boost converters are required to drive strings with more than five LEDs. FIG. 2 (*a*) shows a self-oscillating boost converter with a low-side switch Ts and a sense resistor Rs for peak current detection. The circuitry shown in FIG. 2 includes a boost converter configuration with inductor L, diode D, and capacitor C. According to this embodiment of the present invention, the low side switch Ts and the sense resistor Rs are coupled in series, thereby providing a bypass current path parallel to the LED string LEDstr and the diode D, which is coupled to the string of LEDs. According to this embodiment, fast cycle-by-cycle input and output voltage compensation is possible. Principally, the present configuration transforms the switched voltage sources in boost or buck-boost converter configuration into current sources. The feed-forward compensation established by the sense resistor Rs, the comparator COMP 1 and the control unit CNTL replace the conventional main current sense and control loop. In particular, the feed forward compensation shown in FIG. 2 (*a*) is not only adapted to support the conventional main loop, but it constitutes a complete substitute for the conventional control mechanism. Since the sensed voltage level Vs is compared to the reference voltage level Vpeak in the comparator COMP, the output of which is fed to CNTL, a cycle-by-cycle feedback loop is established to control the low side switch Ts. The analysis of the shown circuitry reveals the following relationship:

The input power amounts to:

$$Pin = Vin * Iin = Vin * \frac{Ipeak}{2}$$

and the output power amounts to:

$$Pout = Vout * Iout = \eta * Pin = \eta * Vin * \frac{Ipeak}{2}$$

From these two formulas it results $$Iout = \frac{(\eta * Vin * Ipeak)}{(2Vout)}$$

If Ipeak is derived from a compensated Vcomp, then $$Ipeak = \frac{Vcomp}{Rs} = Vout * \frac{Vref}{(Vin * Rs)}$$

Accordingly, the following equation is obtained, if the compensated reference voltage Vcomp is used in the above equation for Iout:

$$Iout = \eta * \frac{Vref}{(2Rs)}$$

From the above formulas, it transpires that, as long as the compensation according to this aspect of the invention is used, the output current Iout is basically determined by constants assumed that the efficiency η, Vref, and Rs are constant. This is achieved by compensation of the peak value proportional to the ratio Vout/Vin.

FIG. 2 (*b*) shows the resulting currents through the inductor L, i.e. the current IL, and the current to be supplied to the boost converter at node Vin, i.e. the current Iin. Accordingly, a linearly increasing current Iin into node Vin is to be observed for the time interval dT. If the value Ipeak is reached by the current through the inductor L, the switch Ts is turned off and a the current flows to the LEDs. If the inductor current reaches zero, the control circuit CNTL is triggered by COMP to turn the low side switch transistor Ts on, and the current through inductor L (IL) increases again.

Figure 3:
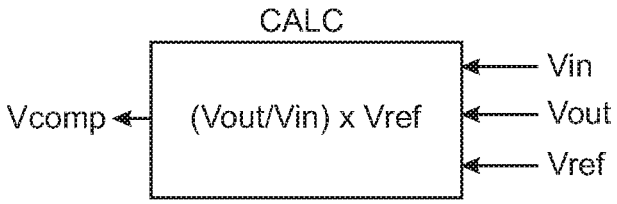
FIG. 3 shows a block diagram of a compensation for the embodiment of FIG. 2 according to an aspect of the present invention, FIGS. 4 (*a*) and (*b*) show a simplified schematic and corresponding waveforms of a second embodiment of the invention.

FIG. 3 shows a block diagram of a compensation for the embodiment of FIG. 2 according to an aspect of the present invention. As mentioned above, the present invention suggests to compensate the peak value in relation to the ratio Vout/Vin. If a compensated voltage value Vcomp is used in the comparator shown in FIG. 2 (*a*), the output current Tout through the LEDs becomes basically independent from variable voltage or current levels. The output current Tout is substantially determined by constants η, Vref, and Rs. FIG. 3 shows a block diagram for a calculation block which provides continuously an appropriate compensation voltage Vcomp based on the input voltage Vin, the output voltage Vout, and the reference voltage Vref. The reference voltage is a constant and can be derived from the conventional circuitry shown in FIG. 2 in a straight forward manner. Once Vref is determined, the block shown in FIG. 3 is suitable to provide a compensation mechanism being advantageous for determining the output voltage. A circuitry as represented by the block CALC in FIG. 3 may, according to an aspect of the present invention, preferably be included in the circuitry of e.g. FIG. 2 (*a*).

Figure 4:
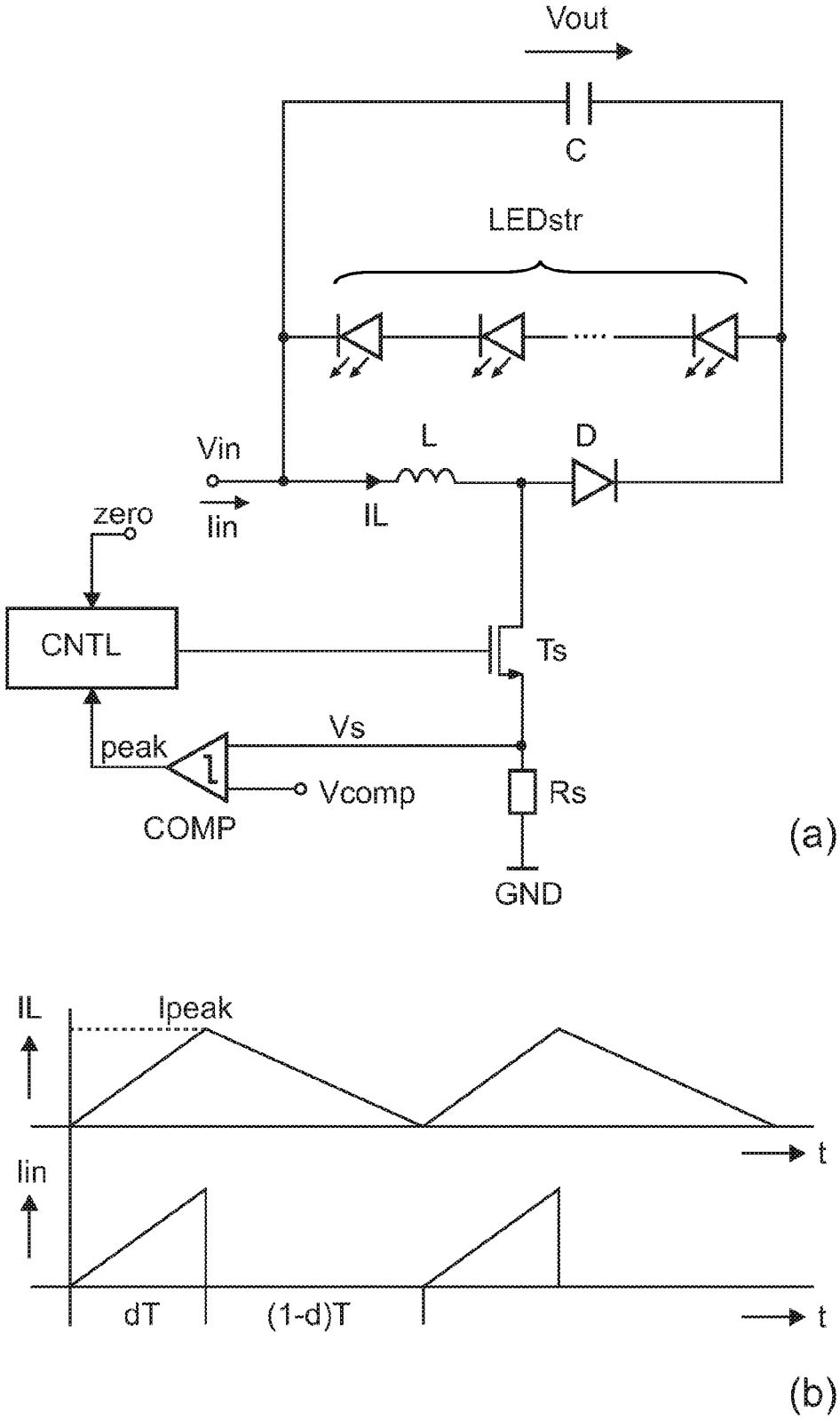

FIG. 4 (*a*) shows a simplified schematic of a second embodiment of the present invention. This configuration is also known as a fly-back or modified-boost converter. The control mechanism relies basically on the switch transistor Ts and a sense resistor Rs for peak current detection. Although the switch transistor Ts and the sense resistor Rs are coupled between the diode D and the inductor L, the LED string LEDstr and the capacitor C are arranged in a loop that is decoupled from ground. The analysis of this current provides the following relations:

The primary current amounts to $$Ipeak = Vin * \frac{dT}{L}$$

The secondary current amounts to $$Ipeak = Vout * \frac{(I - d)T}{L}$$

From these two formulas it results that $$\frac{Vout}{Vin} = \frac{d}{(I - d)} \text{ or } d = \frac{Vout}{(Vin + Vout)}$$

The input power is $$Pin = Vin * Iin = Vin * \frac{dIpeak}{2} = Ipeak * Vin * \frac{Vout}{2(Vin + Vout)}$$

The output power amounts to $$Vout * Iout = \eta * Pin$$
$$= \eta * Ipeak * Vin * \frac{Vout}{2(Vin + Vout)}$$

From that it results that $$Iout = \frac{Pout}{Vout}$$
$$= \eta * Ipeak * \frac{Vin}{2(Vin + Vout)}$$

If Ipeak is derived from a compensated reference voltage Vcomp, then $$Ipeak = \frac{Vcomp}{Rs}$$
$$= Vref * \frac{(Vout + Vin)}{(Vin \cdot Rs)}$$

Accordingly, the following equation is obtained for the output current through the LEDs:

$$Iout = \eta * \frac{Vref}{(2Rs)}$$

So, due to a properly adapted compensated reference voltage Vcomp according to this aspect of the present invention, the output current Tout is basically determined by constants assumed that the efficiency η, Vref, and Rs are constant. This is possible, as the peak value of the voltage across the sensing resistor is compensated proportional to the ratio (Vout+Vin)/Vin.

Figure 5:
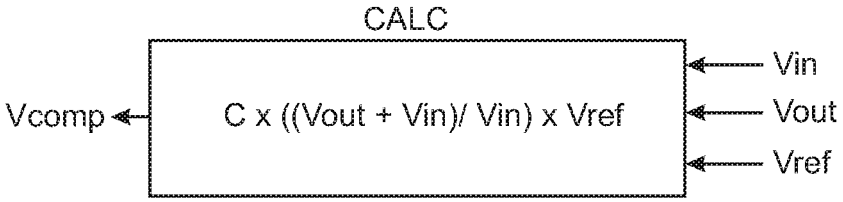
FIG. 5 shows a simplified block diagram of a compensation for the embodiment of FIG. 4 according to an aspect of the present invention, FIGS. 6 (*a*) and (*b*) show a simplified schematic and corresponding waveforms of a third embodiment of the invention.

FIG. 4 (*b*) shows exemplary waveforms for the currents IL and Iin for the circuit of FIG. 4 (*a*). FIG. 5 shows a simplified block diagram of a compensation mechanism according to an aspect of the present invention. The compensation mechanism is suitable to provide a compensation voltage Vcomp for the circuitry shown in FIG. 4 (*a*). Accordingly, the compensation voltage Vcomp is calculated based on the above equation as derived with respect to FIG. 4 (*a*). Accordingly, there is a constant C and the reference voltage Vref being compensated by the input and the output voltage according to the following relation (Vout+Vin)/Vin. As already derived with respect to FIG. 4 (*a*), the compensation voltage Vcomp is to be compensated by a value proportional to this ratio. The calculation block shown in FIG. 5 can be implemented by analog circuits, digital calculation circuitry, digital logic, or any other digital processing and calculation means.

Figure 6:
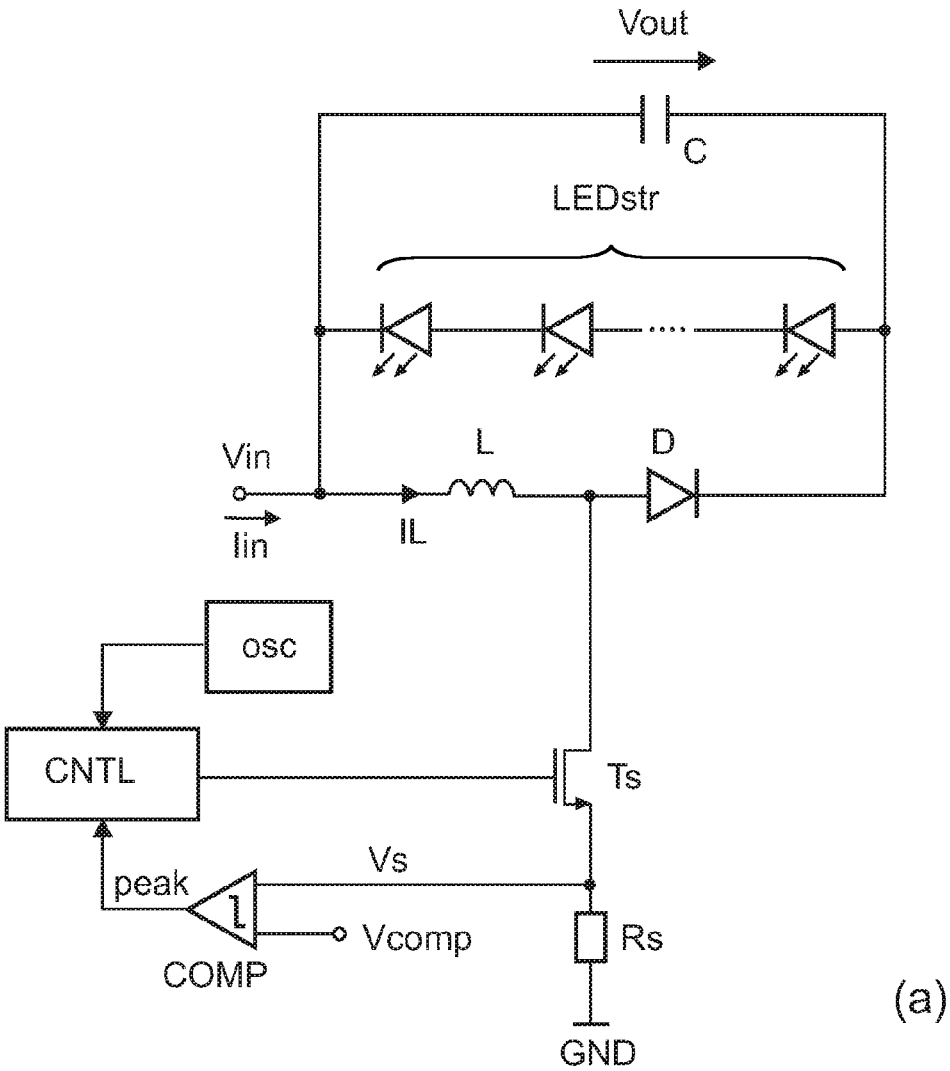
Figure 6:
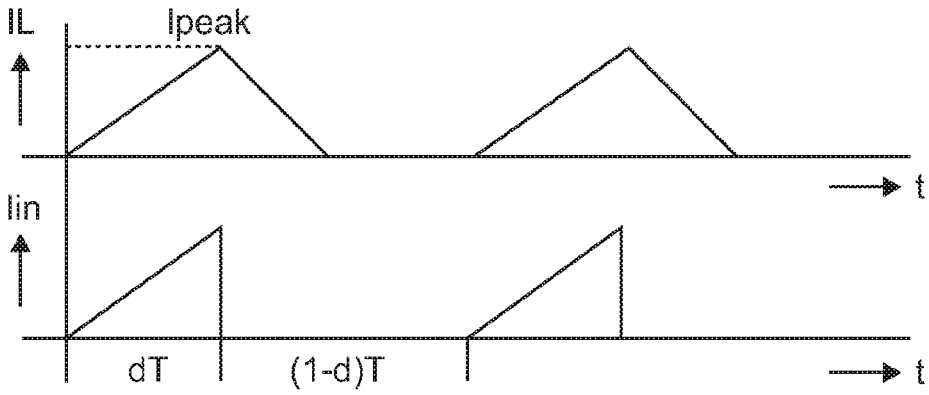

FIG. 6 (*a*) shows a third embodiment according to an aspect of the present invention. FIG. 6 (*a*) shows a discontinuous buck-boost converter that applies basically the same compensation methodology as shown and explained with respect to FIGS. 4 and 5. However, the present typology uses the discontinuous mode. The analysis of the circuitry shown in FIG. 6 (*a*) can be explained by the following equations:

Power in:

$$\begin{aligned} Pin &= Vin * Iin \\ &= Vin * \frac{dIpeak}{2} \\ &= \frac{1}{2} * L * Ipeak^2 * f \end{aligned}$$

Power Out:

$$Pout = Vout * Iout = \eta * Pin = \eta * Vin * Iin$$

From these two formulas it results that $$\begin{aligned} Iout &= \eta * \frac{Pin}{Vout} \\ &= \frac{1}{2} * \eta * f * L * \frac{Ipeak^2}{Vout} \end{aligned}$$

If Ipeak is derived from a compensated Vcomp, then $$Ipeak = \frac{Vcomp}{Rs}$$

-continued $$= \sqrt{\frac{(Vout * Vref)}{Rs}}$$

Accordingly, the following equation is obtained:

$$Iout = \frac{1}{2} * \eta * f * L * \frac{Vref}{Rs^2}$$

If the compensated reference voltage Vcomp is used, the output current is basically determined by constants given that the efficiency η, the frequency f, the inductance L, Vref, and Rs are constant. This is achieved by compensation of Vpeak value proportional to √Vout. The waveforms shown in FIG. 6 (*b*) are similar to those explained with respect to FIG. 5 (*b*) except that the timing is now controlled by an oscillator. Accordingly, the current IL be discontinued, i.e. IL may return to zero and remain at zero for a certain time before it starts rising again.

Figure 7:
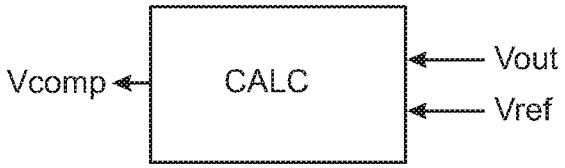
FIG. 7 shows a simplified block diagram of a compensation for the embodiment of FIG. 6 according to an aspect of the present invention, FIGS. 8 (*a*) and (*b*) show a simplified schematic and corresponding waveforms of a fourth embodiment of the invention.

FIG. 7 shows a simplified block diagram of a compensation mechanism relating to an aspect of the present invention. This aspect of the present invention is particularly useful for the circuitry shown in FIG. 6 (*a*). As derived for FIG. 6 (*a*) here above, the compensation voltage is now proportional to $\sqrt{Vout}$. If the peak voltage Vpeak is compensated by $\sqrt{Vout}$, it is possible to provide an output current Tout, which is basically dependent on constants as η, the frequency f, the inductance L, Vref, and Rs.

Figure 8:
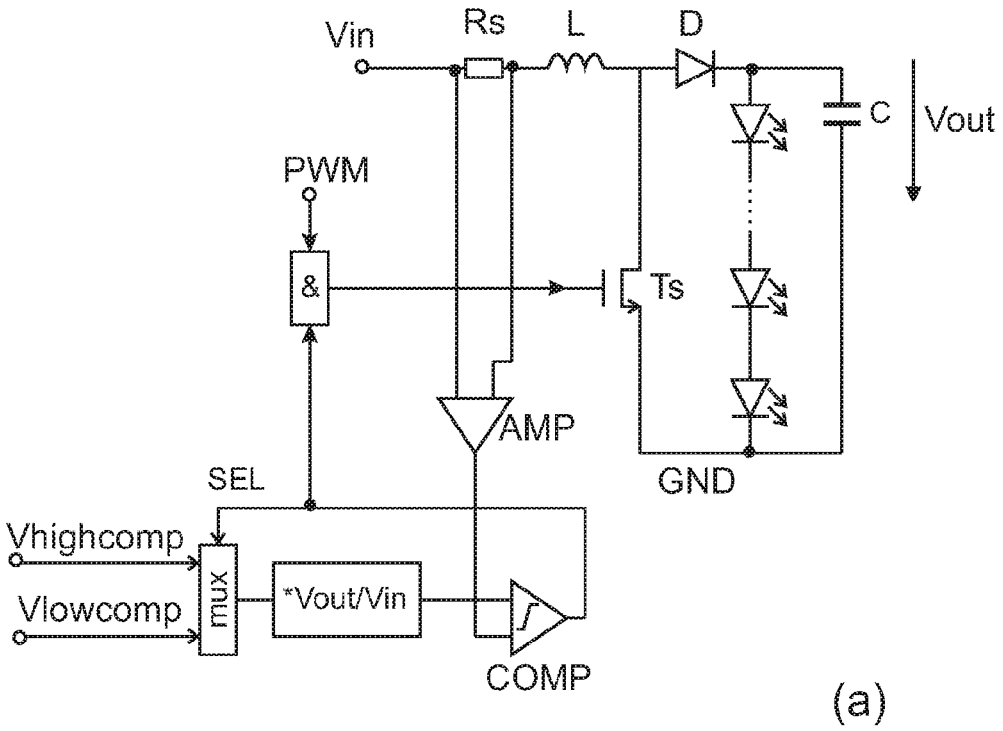
Figure 8:
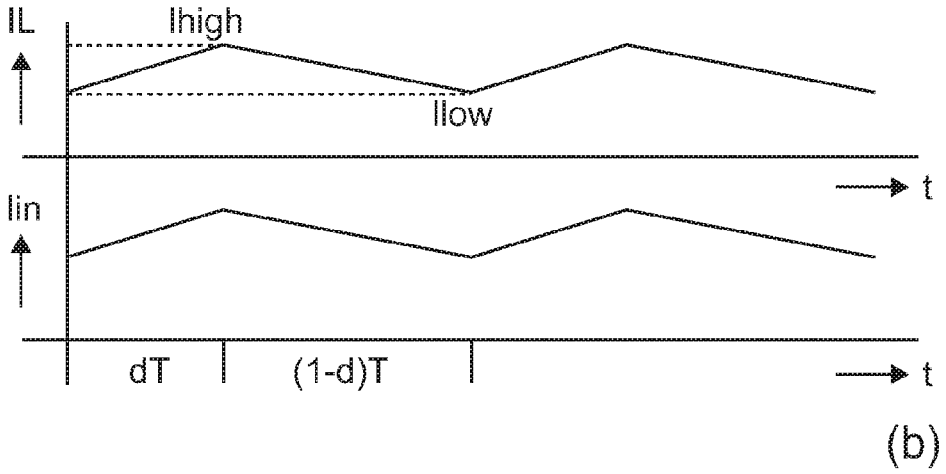

FIG. 8 (*a*) shows a simplified schematic of a fourth embodiment of the present invention. The configuration shown in FIG. 8 (*a*) is a continuous hysteretic boost converter, which applies basically the same methodology as explained with regard to FIG. 6 (*a*) and FIG. 4 (*a*). However, the concept shown in FIG. 8 (*a*) relates to hysteretic control mechanism, where the voltage is controlled between an upper and a lower limit. The inductor L is basically controlled in a cycle-by-cycle mode by hysteretic levels Vhigh and Vlow yielding a current ripple between Ihigh=Vhigh/Rs and Ilow=Vlow/Rs. The select signal SEL selects by multiplexer mux either the signal Vhighcomp or Vlowcomp as one input of the comparator COMP. The selection alternates in response to the output of the comparator COMP. SEL is also passed to the AND gate to let either the PWM signal pass or to turn it off. The other input of the comparator COMP is derived via an amplifier AMP form the sensing resistor Rs. A more detailed analysis of this circuitry shows the following relations:

Average Input Current:

$$Iin = \frac{(Ihigh + Iflow)}{2}$$

Power in:

$$Pin = Vin * \frac{(Ihigh + Ilow)}{2}$$

Power Out:

$$\begin{aligned} Pout &= Vout * Iout \\ &= \eta * Pin \\ &= \eta * Vin * \frac{(Ihigh + Ilow)}{2} \end{aligned}$$

From that it results that $$Iout = \eta * \left(\frac{Vin}{Vout}\right) * \frac{(Ihigh + Ilow)}{2}$$

If Thigh is derived from a compensated Vhigh, then Vhigh:

$$Vhigh = Vhighcomp * \frac{Vout}{Vin}$$

If Ilow is derived from a compensated Vlow, then $$Vlow = Vlowcomp * \frac{Vout}{Vin}$$

Vlow:

From these three formulas it results that $$Iout = \eta * \frac{(Vhighcomp + Vlowcomp)}{2R_s}$$

As for the circuits shown in FIGS. 2, 4, and 6, the output current is also determined by constant values under the presumption that the efficiency ii, Vhighcomp, Vlowcomp, and Rs are constant. This is achieved by compensation of the hysteretic levels Vhigh and Vlow value proportional to ratio Vout/Vin.

FIG. 8 (*b*) shows the corresponding waveforms relating to the circuitry shown in FIG. 8 (*a*). Accordingly, the current through the inductor L denoted by IL varies between an upper limit Thigh and a lower limit Ilow. The same effect occurs for the input current Tin. Accordingly, there is a constant DC portion of the current through the LED string LEDstr and an alternating portion. An input of the comparator COMP is switched between the high level Vhigh and the low level Vlow. The switching occurs each time the output of the comparator COMP changes.

Figure 9:
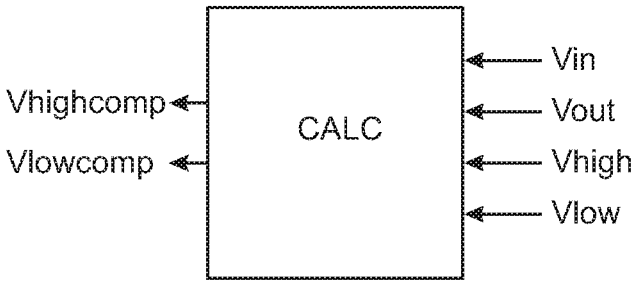
FIG. 9 shows a simplified block diagram of a compensation for the embodiment of FIG. 8 according to an aspect of the present invention.

FIG. 9 shows a simplified block diagram of a calculation mechanism according to an aspect of the present invention. The block diagram shown in FIG. 9 serves as a compensation calculating means for the circuitry shown in FIG. 8 (*a*). The static levels Vhigh and Vlow are compensated proportional to the ratio Vout/Vin in order to provide the compensated hysteretic voltage levels Vhighcomp and Vlowcomp. This calculation step is provided by the calculation block CALC. As mentioned above, the calculation block CALC can be implemented by any means being appropriate to carry out the required calculation steps.

Generally, dimming and boosting of the LED current can be implemented by either amplitude, pulse width modulation, or a combination of both. The embodiments shown in FIG. 2 to FIG. 9 allow an easy implementation by controlling the peak voltage Vpeak. Amplitude modulation can be implemented by changing the setpoint for Vpeak (or Vref for the compensated converters). This can be realized for example by a digital-to-analog converter, such that the amplitude setting can be controlled from a digital processor located in the system. Pulse width modulation can be implemented by switching Vpeak (or Vref) from its normal value (amplitude) to a zero voltage. Alternatively, the pulse width modulation off-period can be implemented by overruling the control block enforcing the gate of switch S to zero.

The present invention provides an electronic device for driving LEDs with an excellent efficiency for switch mode solutions. The switching actions occur for zero-current and zero-voltage. Additional dissipating components such as current sense resistors or dim switches in the LED string are not necessary. The turn off of the current occurs during the off-state dimming. The system according to the present invention provides a good color stability, as the voltage converter provides a high output impedance due to output voltage compensation, a high input rejection, and an accurate PWM dimming due to the fast cycle-by-cycle compensation. As no extra sense resistors, PWM dim switches, error amplifiers, and loop compensation networks are needed, the complexity and the costs for the electronic device according to the present invention are substantially reduced.

The current sense method can be based on sensing voltage across the sense resistor, as described above with regard to the preferred embodiments, but it is also possible to implement the sensing means by field effect transistors, in particular a sense FET mirror, or a current emulation by integration of the inductor voltage.

The present invention is beneficial for the broad variety of applications, such as LCD backlighting, general lighting, and automotive lighting.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A method for driving one or more light emitting diodes, the method comprising the steps of:

switching a switch-mode power converter to produce an output voltage across the one or more light emitting diodes;

sensing a current provided by the switch-mode power converter;

providing a variable input signal to generate a reference voltage, that varies as a function of the output voltage; and controlling the step of switching, in response to a comparison of the sensed current and the reference voltage; and generating the reference voltage in response to a variable input signal, wherein the variable input signal allows for control of current through the one or more light emitting diodes substantially independent from the output voltage.

2. The method of claim 1, wherein the output voltage is concurrent with flow of current along a current path parallel to the one or more light emitting diodes.

3. The method of claim 1, wherein the sensed current is indicative of an amount of current passing through a control switch.

4. The method of claim 1, further including producing the output voltage by converting an input voltage to the output voltage and determining the reference voltage in response to the input voltage.

5. The method of claim 4, further including determining the reference voltage as a ratio of the input voltage to the output voltage.

6. The method of claim 4, wherein determining the reference voltage includes using a formula: C*Vref*(Vout+Vin)/Vin, wherein Vout is the output voltage, Vin is the input voltage, C is a constant value and Vref is a variable input signal that allows for control of current through the one or more light emitting diodes substantially independent from the output voltage.

7. A method for driving a light emitting diode, the method comprising:

using a control switch for switching a switch-mode power converter;

controlling the control switch in response to a sensing value indicative of a current of the switch-mode power converter and for controlling, by the control switch, output voltage of the switched power converter and a current through the light emitting diode; and controlling the current through the light emitting diode and the switch-mode power converter in an arrangement wherein a fly-back diode and an inductor of the switch-mode power converter are arranged to form a ground-free loop with the light emitting diode and wherein the control switch is coupled to provide a parallel current path from between the inductor and the fly-back diode to ground.

8. The method of claim 7, further including using the switch-mode power converter to operate as a boost converter.

9. The method of claim 7, further including using the switch-mode power converter to operate as a fly-back converter.

10. The method of claim 7, further including producing the output voltage by converting an input voltage to the output voltage and determining a reference voltage in response to the input voltage.

11. The method of claim 10, wherein determining the reference voltage includes using a formula: C*Vref*(Vout+Vin)/Vin, wherein Vout is the output voltage, Vin is the input voltage, C is a constant value and Vref is a variable input signal that allows for control of current through the one or more light emitting diodes substantially independent from the output voltage.

12. The method of claim 10, wherein determining the reference voltage includes using a formula: Vref*(Vout+Vin)/Vin, wherein Vout is the output voltage, Vin is the input voltage and Vref is a variable input signal that allows for control of current through the light emitting diode substantially independent from the output voltage of the switch mode power converter and wherein Vref has a high and low compensation value that provide hysteresis levels.

13. The method of claim 7, wherein the switch-mode power converter includes a fly-back converter.

14. The method of claim 7, wherein the switch-mode power converter includes a boost converter.

15. An electronic device for driving one or more light emitting diodes, the electronic device comprising:

switching means for switching a switch-mode power converter that produces an output voltage across the one or more light emitting diodes;

sensing means for sensing a current provided by the switch-mode power converter;

reference voltage means for generating a reference voltage that varies as a function of the output voltage; and control means for controlling a control switch, in response to a comparison of the sensed current and the reference voltage; and generating means for generating the reference voltage in response to a variable input signal, wherein the variable input signal allows for control of current through the one or more emitting diodes substantially independent from the output voltage.

16. An electronic device for driving a light emitting diode, the electronic device comprising:

means for switching a switch-mode power converter; and means for controlling a control switch in response to a sensing value indicative of a current of the switch-mode power converter and for controlling, by the control switch, output voltage of the switched power converter and a current through the light emitting diode, and further adapted to control the current through the light emitting diode and the switch-mode power converter in an arrangement wherein a fly-back diode and an inductor of the switch-mode power converter are arranged to form a ground-free loop with the light emitting diode and wherein the control switch is coupled to provide a parallel current path from between the inductor and the fly-back diode to ground.

* * * * *